US005689869A

United States Patent [19]

Linville et al.

[11] Patent Number: 5,689,869

[45] Date of Patent: Nov. 25, 1997

[54] HANDLE FOR A CASKET SHELL

[75] Inventors: John E. Linville, Batesville, Ind.; Dennis C. Laphan, Cincinnati, Ohio; Anthony S. Casablanca, Batesville, Ind.

[73] Assignee: Batesville Casket Company, Inc., Batesville, Ind.

[21] Appl. No.: 620,113

[22] Filed: Mar. 28, 1996

[51] Int. Cl.[6] ..... A61G 17/00

[52] U.S. Cl. ..... 27/2; 27/1; 27/27

[58] Field of Search ..... 27/2, 3, 4, 5, 6, 27/7, 8, 9, 10, 27, 35; 220/770

[56] References Cited

U.S. PATENT DOCUMENTS

| | | | |
|---|---|---|---|
| D. 93,349 | 9/1934 | King | D99/1 |
| D. 93,383 | 9/1934 | Cohen | D99/1 |
| D. 99,778 | 5/1936 | Cohen | D99/1 |
| D. 203,539 | 1/1966 | Billman | D99/1 |
| D. 232,443 | 8/1974 | Winburn . | |
| D. 346,264 | 4/1994 | Etzel et al. | D99/1 |
| 1,508,745 | 9/1924 | Cassel . | |
| 1,660,019 | 2/1928 | Tazza . | |
| 1,730,666 | 10/1929 | Listing . | |
| 1,828,352 | 10/1931 | Barr | 27/6 |
| 1,887,665 | 11/1932 | Truman . | |
| 2,050,675 | 8/1936 | Tanner . | |
| 2,392,298 | 1/1946 | Thommen . | |
| 2,494,473 | 1/1950 | Dowling . | |
| 2,655,712 | 10/1953 | Glassner . | |
| 2,697,266 | 12/1954 | Raper | 27/6 |
| 2,974,390 | 3/1961 | Nelson . | |
| 3,204,286 | 9/1965 | Hillenbrand . | |
| 3,406,229 | 10/1968 | Cenegy . | |
| 3,488,818 | 1/1970 | Orr . | |
| 3,490,114 | 1/1970 | Connelly et al. . | |
| 3,657,764 | 4/1972 | Relly et al. . | |
| 3,681,820 | 8/1972 | Jalbert . | |
| 3,815,185 | 6/1974 | Owens . | |
| 3,838,482 | 10/1974 | Wallace . | |
| 4,063,337 | 12/1977 | Havey, III . | |
| 4,237,590 | 12/1980 | Work | 27/2 |
| 4,312,104 | 1/1982 | Baker et al. . | |
| 4,320,562 | 3/1982 | Kelley . | |
| 4,337,556 | 7/1982 | Winburn et al. . | |
| 4,730,370 | 3/1988 | Elder . | |
| 4,773,134 | 9/1988 | Kay . | |
| 4,829,639 | 5/1989 | Woedl et al. . | |
| 4,930,197 | 6/1990 | McClive . | |
| 4,944,076 | 7/1990 | Kay et al. . | |
| 4,967,455 | 11/1990 | Elder . | |
| 5,008,990 | 4/1991 | Craft . | |
| 5,144,727 | 9/1992 | Craft . | |
| 5,568,677 | 10/1996 | Tobin | 27/2 |

*Primary Examiner*—Kien T. Nguyen
*Attorney, Agent, or Firm*—Barnes & Thornburg

[57] ABSTRACT

A handle structure for a casket (10) is provided. The handle structure includes a bar (33) and a casket shell (12) spaced apart from the bar (33). The casket shell (12) includes a side panel (28) having an outwardly-facing side surface (66) positioned behind the bar (33) and fixed relative thereto. The side surface (66) includes an outer portion (64) and an edge (60) defining a recessed portion (62) of the side surface (66) positioned inwardly of the outer portion (64) of the side surface (66). The recessed portion (62) cooperates with the outer portion (64) to define a cavity (68) positioned behind the bar (33) so that a person carrying the casket (10) can grip the bar (33) without engaging the side surface (66).

38 Claims, 5 Drawing Sheets

HANDLE FOR A CASKET SHELL

BACKGROUND AND SUMMARY OF THE INVENTION

The present invention relates to caskets, and particularly to a handle for a casket shell. More particularly, the present invention relates to a casket handle structure having a bar that is gripped by pallbearers or others carrying the casket and that is fixed relative to the casket shell. The bar is positioned so that the casket shell and hardware including the bar is conveniently positioned on the casket shell for shipment, for storage, and for interring remains in a burial vault or mausoleum.

Many caskets are provided with "swing bar type" handles or handles mounted on "swing hardware" that includes a handle swingably mounted to the casket shell so that the handle swings outwardly from a non-operative position to an outward operative position when the casket is to be carried. See, for example, U.S. Pat. Nos. 3,204,286 to Hillenbrand and 3,657,764 to Relly et al., both of which are assigned to the assignee of the present invention. Swing hardware permits the person carrying the casket to grasp the handle without engaging the casket shell while also permitting the handle and associated hardware to fit within a limited envelope of space surrounding the casket during storage, during transport on shipping pallets or in shipping containers, and during use when the casket is placed into a mausoleum or a burial vault.

Caskets having handles fixed relative to the casket shell are also known in the art. For example, U.S. Pat. Nos. 4,337,556 to Winburn et al. and 4,312,104 to Baker et al., both of which are assigned to the assignee of the present invention, each show caskets having handles that are fixed relative to the shell. In addition, U.S. Pat. Nos. 4,930,197 to McClive; 3,681,820 to Jalbert; 2,494,473 to Dowling; 2,392,298 to Thommen; 4,730,370 to Elder; 4,773,134 to Kay; 4,967,455 to Elder; 1,508,745 to Cassel; 2,655,712 to Glassner; 1,660,019 to Tazza; 1,730,666 to Listing; 2,974,390 to Nelson; 3,406,229 to Cenegy; and 4,829,639 to Woedl et al. all disclose caskets having handles that are fixed relative to the casket shell.

What is needed is a casket having a casket shell including low cost hardware such as a handle that is fixed relative to the casket shell. The casket shell should be configured to receive such hardware so that the casket shell and hardware are positioned to lie within a space defined by a limited envelope surrounding the casket that will permit easy transportation, storage, and placement of the casket into a burial vault or mausoleum while at the same time efficiently utilizing the space within the limited envelope of space surrounding the casket so that the size of the casket shell can be maximized. In addition, funeral directors, pallbearers, and others carrying the casket will appreciate a handle that can be grasped while carrying the casket shell without rubbing or scraping the knuckles of the person carrying the casket against the casket shell, thereby allowing the person carrying the casket to tightly grasp the handle.

According the present invention a handle structure for a casket is provided. The handle structure includes a bar and a casket shell that is spaced apart from the bar and that includes a side panel having an outwardly-facing side surface positioned behind the bar. The bar is fixed relative to the side panel. The side surface includes an outer portion and an edge defining a recessed portion. The recessed portion of the side surface is positioned inwardly of the outer portion of the side surface and the recessed portion cooperates with the outer portion to define a hand-grip cavity positioned behind the bar. The recessed portion is thus arranged so that a person carrying the casket can grip the bar without engaging the side surface of the casket shell.

In preferred embodiments, a casket shell including a handle in accordance with the present invention includes an elongated bottom having first and second spaced-apart elongated side edges. First and second spaced-apart side panels are appended to the side edges of the bottom and extend upwardly therefrom, the first and second side panels cooperating with the bottom to define a casket interior region. A bar or handle is fixed relative to the first side panel and is spaced apart therefrom on the outside of the casket. The distance between the bar and the first side panel is minimized to position the bar within a limited envelope of space surrounding the casket so that the casket fits on shipping pallets and other shipping containers as well as within most burial vaults and mausoleums. At the same time, the bar is spaced apart from the portion of the first side panel behind the bar by at least a "grasping distance," which is the minimum distance that the bar can be spaced apart from the first side panel so that a pallbearer or other person carrying the casket can grasp the bar without engaging the first side panel.

The first side panel of the casket shell includes a side surface having an outer portion defining a generally vertically-extending vertical plane. The side surface is formed to include an edge defining a recessed portion of the side surface. The recessed portion is inwardly spaced apart from the vertical plane and is thus positioned toward the interior region of the casket. The recessed portion of the side surface and the vertical plane cooperate to define a hand-grip cavity.

The hand-grip cavity is positioned to lie behind the bar. Positioning the hand-grip cavity behind the bar allows the bar to be spaced apart from the recessed portion of the side surface by the grasping distance so that the pallbearer or other person carrying the casket can grip the bar and carry the casket without rubbing or scraping their knuckles against the side surface of the first side panel while also minimizing the distance that the bar is spaced apart from the first side panel so that the bar easily fits within the above-noted envelope of space surrounding the casket.

Positioning the hand-grip cavity behind the bar allows the bar to be spaced apart from the vertical plane defined by the outer portion of the side surface of the first side panel by an amount less than the grasping distance. Thus, the inclusion of the hand-grip cavity on the outer surface of the first side panel allows a person to grip the bar and carry the casket while also minimizing the distance between the vertical plane defined by the outer portion of the side surface and the bar to minimize the envelope of space around the casket required for storage, shipment, and use of the casket.

The handle in accordance with the present invention is a low cost structure that allows the person carrying the casket to grasp the bar tightly without engaging the outer portion of the side surface of the casket shell. In addition, by minimizing the distance between the bar and the outer portion of the side surface of the casket shell, the casket having the handle in accordance with the present invention will easily fit into most burial vaults and mausoleums as well as onto shipping pallets and other storage or shipping containers for caskets. Also, by having a handle that is fixed relative to the side panel of the casket rather than being moveable with respect thereto minimizes the opportunity for mishap during shipping or handling causing swingable handles to inadvertently swing resulting in damaging contact with the casket shell carrying the swingable handles or other items adjacent to the handles.

However, if it is desired to use handles that are mounted on swing hardware so that the handles can swing relative to the casket shell, the casket shell in accordance with the present invention can accommodate swing hardware by positioning the handle and the hardware within the recessed portion. Preferably, the handle and the swing hardware are mounted so that the handle is received by the recessed portion and is flush with the generally vertical plane defined by the outer portion of the side surface when the handle is in the downward non-operative position and swings outwardly to the operative position when the casket is carried. Mounting the handle and swing hardware as described within the hand-grip cavity provides for an efficient use of space allowing the size of the casket shell to be maximized while still fitting within the limited envelope of space surrounding the casket.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF DRAWINGS

The detailed description particularly refers to the accompanying figures in which.

DETAILED DESCRIPTION OF THE DRAWINGS

Figure 1:
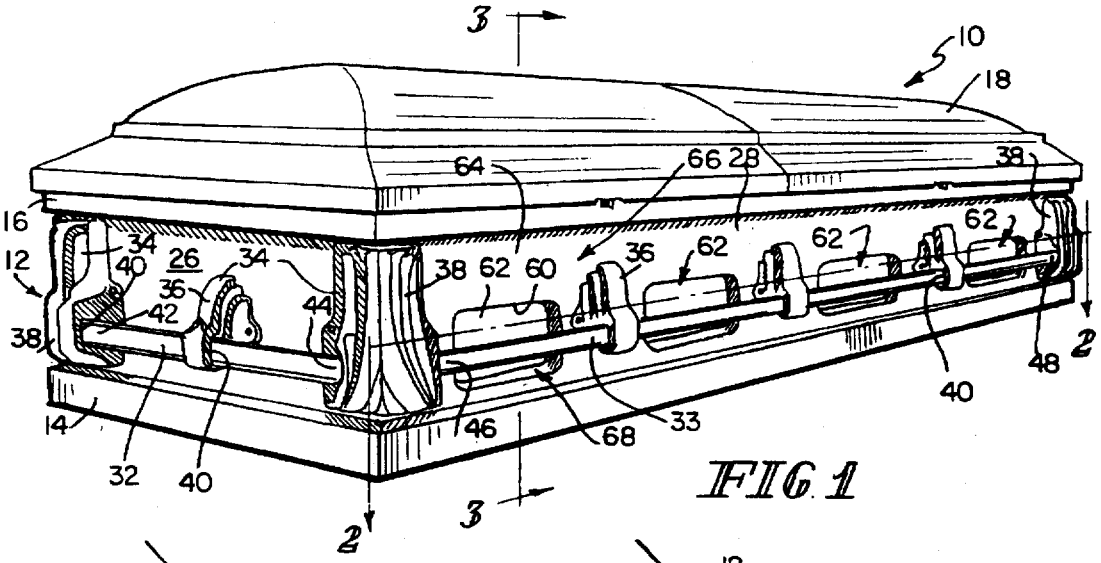
FIG. 1 is a perspective view of a casket in accordance with the present invention showing a side panel of the casket shell having a side surface formed to include a plurality of recessed portions and a side bar fixed to the casket shell side panel and positioned to lie in front of the recessed portions.
Figure 3:
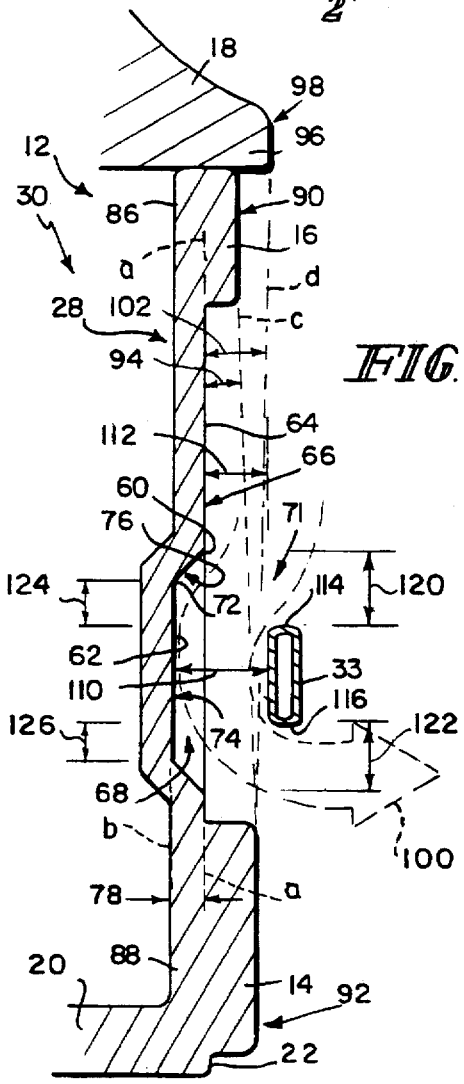
FIG. 3 is a dead sectional view taken along line 3—3 of FIG. 1 showing the shape of the side surface of the side panel adjacent to one of the recessed portions and the position of the side bar spaced apart from and in front of the recessed portion by a distance of at least a "grasping distance" that is sufficient to allow a pallbearer or other person carrying the casket shell to grasp the bar without engaging the side surface of the casket side panel.
Figure 4:
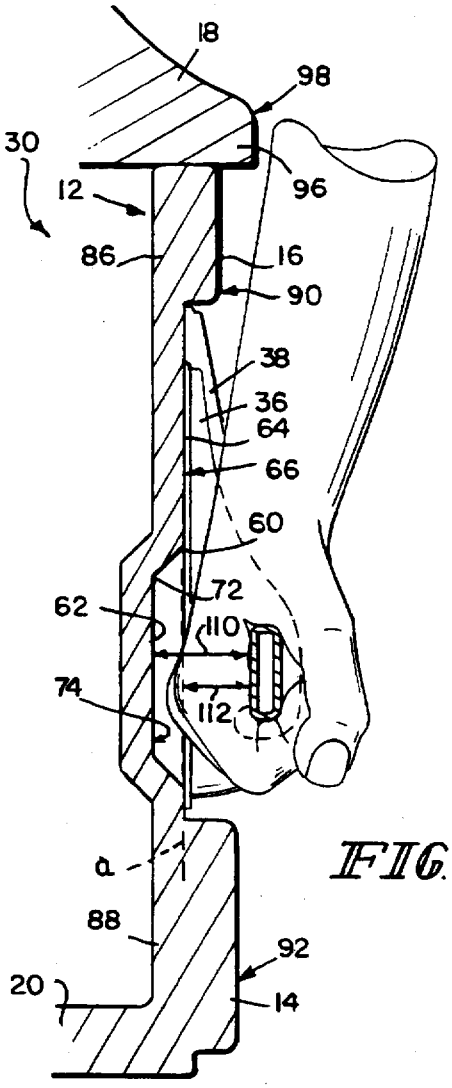
FIG. 4 is a view similar to FIG. 3 showing a hand and arm of a pallbearer or other person grasping the bar while carrying the casket shell, the knuckles of the person grasping the bar being spaced apart from the side surface of the casket side panel.

An illustrative casket 10 in accordance with the present invention includes a casket shell 12 formed to include a base 14 and an upper rim 16 as shown in FIGS. 1, 3, and 4. A lid 18 is attached to rim 16 by conventional hinging mechanisms (not shown) and is movable between a closed position, shown in FIG. 1, and an open position having lid 18 away from rim 16 to display the contents of casket shell 12.

Casket shell 12 includes an elongated bottom 20 having an elongated first side edge 22, an elongated second side edge (not shown) spaced apart from first side edge 22, a head end edge 24, and a foot end edge (not shown) that is longitudinally spaced apart from head end edge 24. A head end panel 26 is attached to head end edge 24 and extends upwardly therefrom, a foot end panel 27 is attached to the foot end edge and extends upwardly therefrom, a first side panel 28 is attached to the first side edge and extends upwardly therefrom, and a second side panel 29 is attached to the second side edge and extends upwardly therefrom. First side panel 28 and second side panel 29 cooperate with bottom 20, head end panel 26, and foot end panel 27 to define an interior region 30 of casket shell 12. Preferably, first side panel 28 and second side panel 29 are of unitary construction and can be formed by stamping side panels 28, 29 from a sheet of material, molding side panels 28, 29, or by any other suitable forming process without exceeding the scope of the invention as presently perceived.

In the illustrative and preferred embodiment of casket shell 12, foot end panel 27 is substantially similar to head end panel 26 and second side panel 29 is substantially similar to first side panel 28. The description herein related to head end panel 26 is thus descriptive of foot end panel 27 and the description herein related to first side panel 28 is descriptive of second side panel 29. Therefore, unless otherwise noted, the description below of head end panel 26 will also apply to foot end panel 27 and the description below of first side panel 28 will also apply to second side panel 29.

Bars 32, 33 are connected and fixed relative to casket shell 12 as shown in FIG. 1. Bosses 34 are fixed to head end panel 26 and first side panel 28 and include side bosses 36 projecting outwardly from panels 26, 28 of casket shell 12 and corner bosses 38 projecting outwardly from the corners of casket shell 12. Bosses 34 are formed to include openings 40 receiving bars 32, 33 and fixing bars 32, 33 to casket shell 12. Bosses 34 are preferably of unitary construction and are configured to hold bars 32, 33 in a fixed position relative to panels 26, 28 of casket shell 12. If desired, bosses 34 can be provided with an ornamental design to enhance the aesthetic appearance of casket 10.

Bars 32, 33 preferably include a pair of end bars 32, one end bar 32 extending along head end panel 26 and the other end bar 32 extending along foot end panel 27, and a pair of side bars 33, one side bar 33 extending along first side panel 28 and the other side bar 33 extending along second side panel 29. In preferred embodiments, each end bar 32 includes a first end 42 fixed to one corner boss 38 and a second end 44 fixed to another corner boss 38, bar 32 extending therebetween through an opening 40 formed in side boss 36 that is positioned between the two corner bosses 38 as shown in FIG. 1. Likewise, side bar 33 has a first end 46 fixed to one corner boss 38 and a second end 48 fixed to another corner boss 38, side bar 33 extending therebetween through openings 40 formed in three side bosses 36 positioned to lie between corner bosses 38.

Although the preferred bars 32, 33 are unitary bars extending between corner bosses 38, bars 32, 33 can also be comprised of bar sections each of which terminates within a boss 34. In this alternative configuration, the illustrative casket shell shown in FIG. 1 would include an end bar having two separate end bar sections, each end bar section being fixed to one corner boss 38 and one side boss 36. In addition, in this alternative configuration, the illustrative casket shell would include a side bar having four separate side bar sections, each side bar section being fixed to two bosses 34. It is therefore within the scope of the invention as presently perceived to provide bars 32, 33 of unitary construction and to provide bars 32, 33 comprised of a plurality of separate bar sections.

Each of first and second side panels 28, 29 is additionally formed to include an outwardly-facing side surface 66 having a plurality of longitudinally spaced-apart apart edges 60. Each edge 60 defines a recessed portion 62 of side surface 66 that is recessed inwardly from an outer portion 64 of side surface 66. Each recessed portion 62 defines a hand-grip cavity 68 as shown in FIGS. 1–5.

Figure 2:
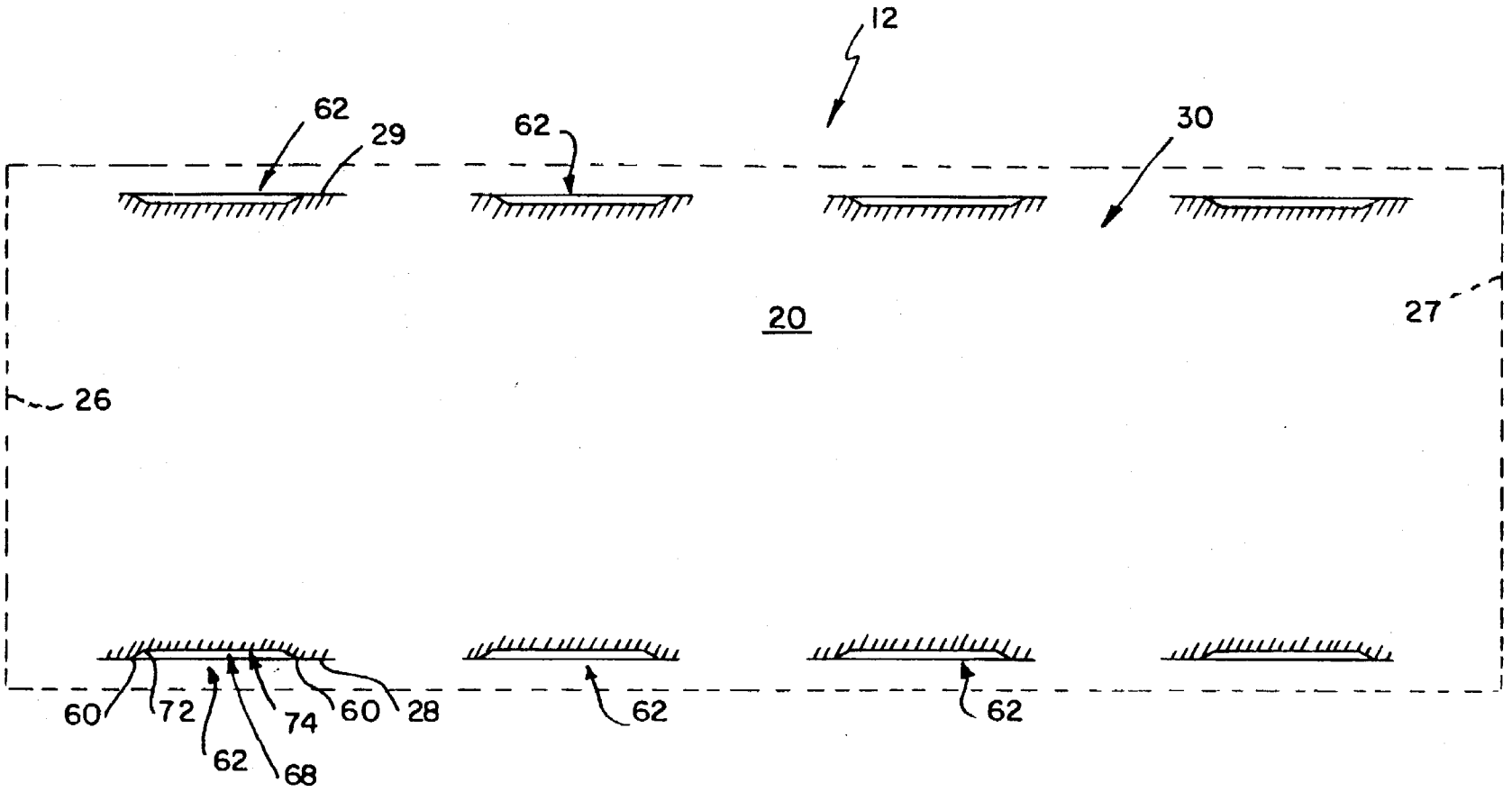
FIG. 2 is a diagrammatic sectional view taken along line 2—2 of the casket shell of FIG. 1 showing the plurality of recessed portions positioned on both the first and second side panels of the casket shell.

Side bar 33 includes a plurality of hand grips 70 described below with reference to FIG. 5 and each hand-grip cavity 68 is positioned to lie behind one of the hand grips 70 of side bar 33. This positioning of recessed portions 62 allows recessed portions 62 to operate as "targets" indicating where pallbearers or others carrying casket shell 12 (hereinafter "pallbearers") should be positioned to be properly spaced-apart and distributed along side panels 28, 29 of casket shell 12 when carrying casket 10 as shown in FIG. 2.

Each recessed portion 62 of illustrative and preferred casket shell 12 is preferably substantially similar to each other recessed portion 62 formed in side surface 66. The description below of one of recessed portions 62, particularly with reference to FIGS. 3–5, is descriptive of each recessed portion 62, and the description below of preferred recessed portion 62 should be taken as a description of each recessed portion 62 of illustrative and preferred side surface 66 of casket shell 12.

Edge 60 of side surface 66 of casket shell 12 is an outer edge of recessed portion 62 as shown best in FIGS. 2–5. Recessed portion 62 also preferably includes an inner edge 72 defining a generally planar surface 74 that preferably also defines an innermost portion of recessed portion 62 as shown best in FIGS. 3 and 4. If desired, recessed portion 62 and particularly planar surface 74 can be provided with one or more appliques (not shown) or other ornamentation to enhance the aesthetic appearance of casket 10.

A transition surface 76 is positioned to lie between outer edge 60 and inner edge 72. Although illustrative transition surface 76 is shown to incline gradually inwardly from outer edge 60 to inner edge 72 defining a ramped portion therebetween, it is within the scope of the invention as presently perceived for transition surface 76 to be at any reasonable angle relative to recessed surface 74, including being generally perpendicular to recessed surface 74 or being at an acute angle with respect to recessed surface 74 so that inner edge 72 is larger than outer edge 60.

Outer portion 64 of side surface 66 of first side panel 28 defines a generally vertical outer plane indicated by line a (plane a extends perpendicular to the page in the illustrations) as shown in FIGS. 3 and 4. Recessed surface 74 also defines a plane b (plane b extends perpendicular to the page in the illustrations). Plane b is inwardly spaced apart from plane a toward interior region 30 of casket shell 12 by a distance 78 as shown best in FIG. 3.

First side panel 28 is formed to include a longitudinally extending top 86 and a longitudinally extending bottom 88. Upper rim 16 is appended to top 86 of first side panel 28 and projects outwardly therefrom to an outer surface 90 of upper rim 16 as shown in FIGS. 3 and 4. Likewise, base 14 is appended to bottom 88 of first side panel 28 and projects outwardly therefrom to an outer surface 92 of base 14. Outer surface 90 of upper rim 16 cooperates with outer surface 92 of base 14 to define a generally vertically extending plane indicated by line c (plane c extends perpendicular to the page in the illustrations). Plane c is outwardly spaced apart from plane a by a distance 94. Although plane c of illustrative casket shell 12 is not parallel to plane a, the configurations of upper rim 16 and base 14 can be adjusted so that planes a and c are parallel or are at any desired angle relative to one another without exceeding the scope of the invention as presently perceived.

Side bar 33 is outwardly spaced apart from side surface 66 of first side panel 28 as shown best in FIGS. 3 and 4. In preferred embodiments, side bar 33 is in front of and spaced apart from recessed surface 74 and is spaced apart from and positioned to lie in front of plane c so that side bar 33 and bosses 34 define the outer extremities of casket shell 12. Although the preferred casket shell 12 is configured so that side bar 33 is positioned to lie in front of plane c defined by outer surface 90 of upper rim 16 and outer surface 92 of base 14, it is within the scope of the invention as presently perceived to adjust the shape of casket shell 12 or to adjust the positions of side bar 33 and recessed surface 74 so that side bar 33 is positioned to lie adjacent to plane c or even between plane a and plane c so that upper rim 16 and base 14 define the outer extremities of casket shell 12.

Lid 18 of casket 10 is carried by upper rim 16 as shown best in FIGS. 3 and 4. Lid 18 includes a lip 96 surrounding upper rim 16 and defining an outer surface 98 of lip 96 and lid 18. Outer surface 98 of lid 18 cooperates with outer surface 92 of base 14 to define a generally vertically extending plane indicated by line d (plane d extends generally perpendicular to the page in the illustrations). Plane d is outwardly spaced apart from plane a by distance 102.

In preferred embodiments, side bar 33 is outwardly spaced apart from and is positioned to lie in front of plane d so that side bar 33 and bosses 34 define the outer extremities of casket 10. Although the preferred casket 10 is configured so that side bar 33 is positioned to lie in front of plane d defined by outer surface 98 of lid 18 and outer surface 92 of base, it is within the scope of the invention as presently perceived to adjust the shape of casket shell 12 and lid 18 or to adjust the positions of side bar 33 and recessed surface 74 so that side bar 33 is positioned to lie adjacent to plane d or so that side bar 33 is positioned to lie between plane d and plane a so that outer surface 98 of lid 18 and outer surface 92 of base 14 define the outer extremities of casket 10.

Hand-grip cavity 68, defined by plane a and side surface 66 of first side panel 28 that includes outer portion 64, outer edge 60, transition surface 76, inner edge 72, and recessed surface 74, cooperates with side bar 33 and base 14 to define a hand-receiving space 71 for receiving the hand of the pallbearer. Hand-receiving space 71 is a generally serpentine-shaped space as indicated by double dashed arrow 100 as shown in FIG. 3. It can be seen that to grasp side bar 33 as shown in FIG. 4, the pallbearer snakes his fingers through hand-receiving space 71 along the path indicated by arrow 100 shown in FIG. 3.

Serpentine-shaped hand-receiving space 71 of casket shell 12 allows the pallbearer to grasp side bar 33 without engaging side surface 66 of first side panel 28 with his hand or knuckles as shown in FIG. 4. This result is achieved by having side bar 33 spaced apart from recessed surface 74 and by positioning recessed surface 74 directly behind side bar 33 by a predetermined distance 110 as shown in FIGS. 3 and 4. Predetermined distance 110 is at least a "grasping distance," which is the minimum distance that side bar 33 needs to be spaced apart from side surface 66 of first side panel 28 to allow a pallbearer to grip side bar 33 without engaging side surface 66 of first side panel 28. However, predetermined distance 110 can be greater than the grasping distance, if desired, without exceeding the scope of the invention as presently perceived. In illustrative and preferred casket shell 12, distance 110 is approximately 1.5 inches (3.8 cm), although it has been found that distance 110 can be as small as 1⅜ inches (3.5 cm) without causing the pallbearer to engage side surface 66 when grasping side bar 33.

Forming first side panel 28 to include hand-grip cavity 68 and placing side bar 33 in front of hand-grip cavity 68 by a distance of at least the grasping distance allows side bar 33 to be spaced apart in front of plane a by a distance 112 that is less than the grasping distance and less than predetermined distance 110. It can be seen in the illustrative and preferred casket shell 12 that the knuckles of the person carrying casket 10 pass through plane a while the person grasps side bar 33 as shown in FIG. 4, showing that distance 112 between side bar 33 and outer portion 64 of side surface 66 is less than the grasping distance.

If side surface 66 of first side panel 28 were not formed to include hand-grip cavity 68, then side bar 33 would need to be spaced apart from plane a by at least the grasping distance rather than by distance 112 that is less than the grasping distance and that is less than distance 110. Positioning side bar 33 further from plane a, and thus further from first side panel 28, requires side bar 33 and bosses 34 to project a greater distance in front of plane a than is possible when side surface 66 is formed to include hand-grip cavity 68, thus increasing the size of the envelope of space surrounding casket shell 12 that contains bars 33 and bosses 34.

Thus, including recessed portion 62, which defines hand-grip cavity 68 on first side panel 28, allows side bar 33 to be fixed to first side panel 28 closer to first side panel 28 than the grasping distance. Specifically, side bar 33 can be fixed closer to first side panel 28 than the grasping distance by distance 78 that is the distance between planes a and b, and that is the distance that recessed surface 74, and thus the innermost portion of recessed portion 62, is inwardly spaced apart from outer portion 64 of side surface 66.

Figure 5:
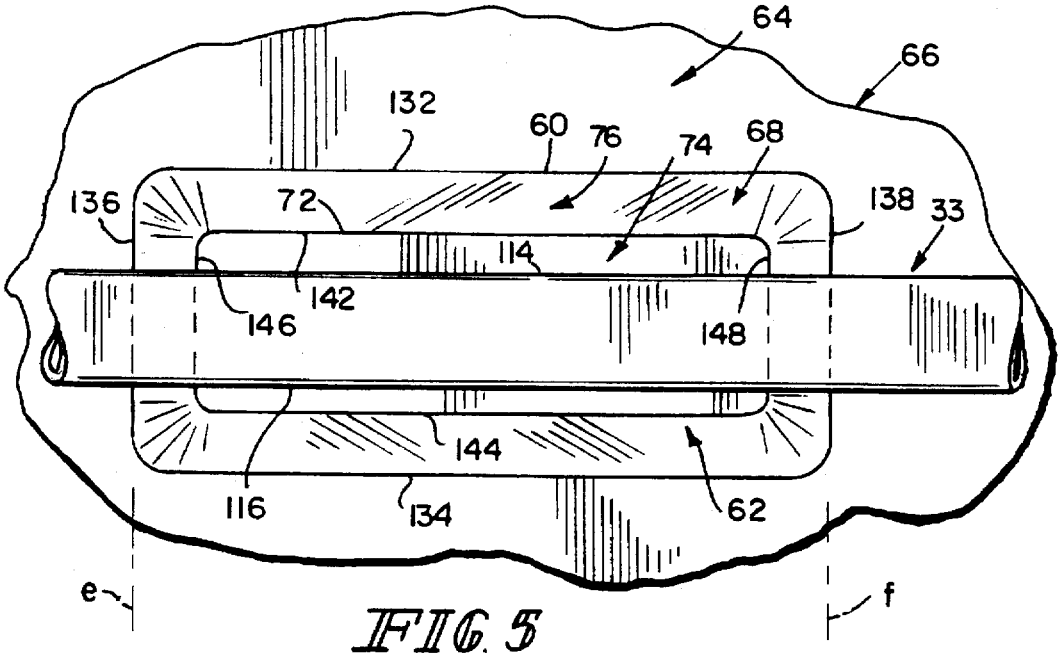
FIG. 5 is an elevation view of one of the rectangular recessed portions and one of the side bars extending in front of the recessed portion.

Side bar 33 includes an elongated top 114 and an elongated bottom 116 spaced apart from top 114 as shown in FIGS. 3–5. Top 114 is spaced apart from an uppermost portion of outer edge 60 by a distance 120 and bottom 116 is spaced apart from a lowermost portion of outer edge 60 by a distance 122 as shown in FIGS. 3 and 5. Likewise, top 114 of side bar 33 is spaced apart from an uppermost portion of inner edge 72 by a distance 124 and bottom 116 of side bar 33 is spaced apart from a lowermost portion of inner edge 72 by a distance 126.

In the illustrative and preferred embodiment, distance 120 between top 114 of side bar 33 and uppermost portion of outer edge 60 is slightly greater than distance 122 between bottom 116 of side bar 33 and the lowermost portion of outer edge 60 so that side bar 33 is positioned to lie adjacent to but slightly below a vertical center of recessed portion 62. Also, in the illustrative and preferred embodiment, the distance 124 between top 114 of side bar 33 and the uppermost portion of inner edge 72 is slightly greater than the distance 126 between bottom 116 of side bar 33 and the lowermost portion of inner edge 72 so that side bar 33 is positioned to lie adjacent to but slightly below a vertical center of recessed surface 74.

Although in the illustrative and preferred embodiment side bar 33 is positioned to lie adjacent to but slightly below the vertical center of recessed portion 62, side bar 33 can be otherwise positioned without exceeding the scope of the invention as presently perceived, so long as the pallbearer can grasp the fixed side bar 33 without engaging side surface 66 of first side panel 28 as shown in FIG. 4. For example, distance 120 between top 114 of side bar 33 and the uppermost portion of outer edge 60 can be less than distance 122 between bottom 116 of side bar 33 and the lowermost portion of outer edge 60 so that side bar 33 is positioned above the vertical center of recessed portion 62.

Also, although in the illustrative and preferred embodiment side bar 33 is positioned to lie adjacent to but slightly below the vertical center of each recessed surface 74, side bar 33 can be otherwise positioned without exceeding the scope of the invention as presently perceived, so long as the pallbearer can grasp the fixed side bar 33 without engaging side surface 66 of first side panel 28 as shown in FIG. 4. For example, distance 124 between top 114 of side bar 33 and an uppermost portion of inner edge 72 can be less than distance 126 between bottom 116 of side bar 33 and the lowermost portion of inner edge 72 so that side bar 33 is positioned above the vertical center of generally planar recessed surface 74.

It can thus be seen that side bar 33 can be infinitely positioned vertically relative to the uppermost and lowermost portions of outer edge 60 of recessed portions 62. Side bar 33 can be positioned in any vertical position relative to the uppermost and lowermost portions of outer edge 60 so long as recessed portions 62 are positioned relative to side bar 33 so that the pallbearer can grasp side bar 33 without engaging side surface 66. Likewise, it can be seen that side bar 33 can be infinitely positioned vertically relative to uppermost and lowermost portions of inner edge 72 of recessed surface 74. Side bar 33 can be positioned in any vertical position relative to the uppermost and lowermost portions of inner edge 72 so long as recessed surface 74, and thus the innermost portion of recessed portion 62, is positioned relative to side bar 33 so that the pallbearer can grasp side bar 33 without engaging side surface 66.

In addition, casket shell 12 can be formed without inner edge 72 and generally planar recessed surface 74. Instead, recessed portion 62 of side surface 66 can be shaped to have no planar surfaces. Recessed portion 62 can be rounded, recessed portion 62 can be shaped to include a cavity for each knuckle of the pallbearer, or recessed portion 62 can be formed into any other suitable shape that will allow a pallbearer to grasp side bar 33 without engaging first side panel 28. Thus, it is within the scope of the invention as presently perceived to provide a casket shell having recessed portions 62 of any shape so long as an innermost portion of each recessed portion 62 adjacent to the hand of the pallbearer is spaced apart from side bar 33 by at least the grasping distance.

As described above, side bar 33 includes a first end 46 mounted to a first boss 34 and a second end 48 mounted to a second boss 34 as shown in FIG. 1. Bosses 34 are longitudinally spaced apart along side surface 66 of first side panel 28. Recessed portions 62 are positioned to lie between bosses 34. Thus, it can be seen that side bar 33 extends across the portion side surface 28 defining recessed portions 62.

In the illustrative and preferred embodiment of casket shell 12, outer edge 60 is formed to include a top edge portion 132 defining the uppermost portion of outer edge 60, a bottom edge portion 134 defining the lowermost portion of outer edge 60, a first side edge portion 136, and a second side edge portion 138 as shown in FIG. 5. Illustratively, edge portions 132, 134, 136, 138 cooperate to define recessed portion 62 generally in the shape of a rectangle.

First side edge portion 136 defines a plane indicated by line e (plane e is perpendicular to the page in the illustration). Second side edge portion 138 defines a plane indicated by line f (plane f extends in direction perpendicular to the page in the illustration). As can be seen, side bar 33 extends in front of recessed surface 74 and through both of plane e and plane f so that side bar 33 extends along the full length of recessed portion 62.

Also, in the illustrative and preferred embodiment of casket shell 12, inner edge 72 is formed to include a top edge portion 142 defining the uppermost portion of inner edge 72, a bottom edge portion 144 defining the lowermost portion of inner edge 72, and first and second side edge portions 146, 148 defining the side-to-side extremes of inner edge 72 as shown in FIG. 5. Illustratively, edge portions 142, 144, 146, 148 cooperate to define recessed surface 74 generally in the shape of a rectangle.

Figure 6:
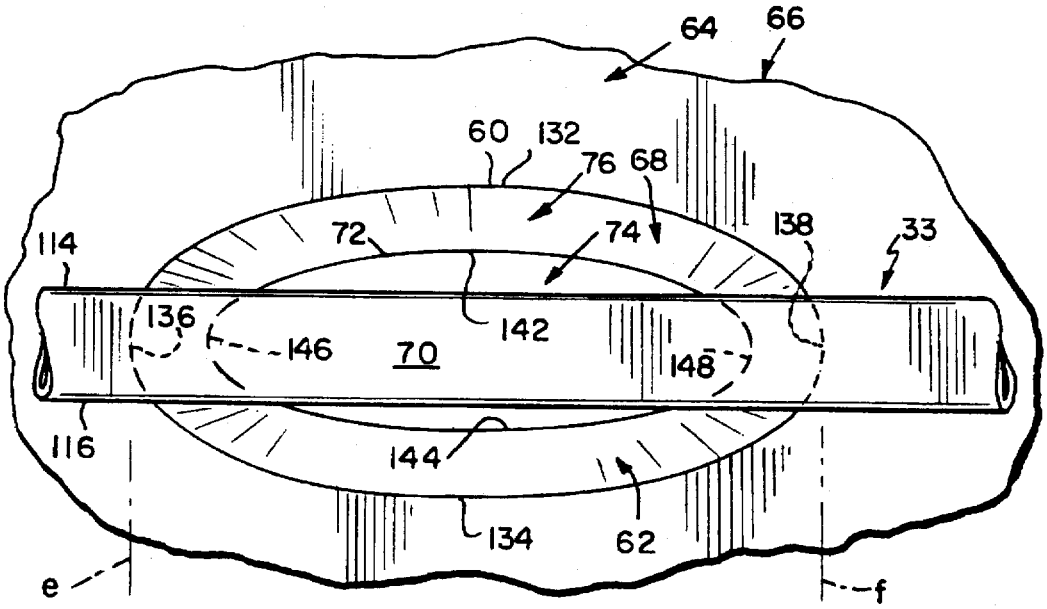
FIG. 6 is a view similar to FIG. 5 of an oval-shaped recessed portion of a casket shell and one of the side bars in front of the oval-shaped recessed portion.

It will be clear to those skilled in the art that although illustrative outer edge 60 and inner edge 72 both define rectangles, outer edge 60 and inner edge 72 can each define shapes other than rectangles. For example, outer edge 60 and inner edge 72 can each define ovals as shown in FIG. 6. In such instance, outer edge 60 is still formed to include a top edge portion 132 defining the uppermost portion of outer edge 60, a bottom edge portion 134 defining the lowermost portion of outer edge 60, and first and second side edge portions 136, 138 defining the side-to-side extremes of outer edge 60 as shown in FIG. 6.

First side edge portion 136 defines a plane indicated by line e (plane e is perpendicular to the page in the illustration) as shown in FIG. 6. Second side edge portion 138 defines a plane indicated by line f (plane f extends in direction perpendicular to the page in the illustration). As can be seen, side bar 33 extends in front of recessed surface 74 and through both of plane e and plane f so that side bar 33 extends along the full length of recessed portion 62.

Inner edge 72 can also be formed in the shape of an oval and can include a top edge portion 142 defining the uppermost portion of inner edge 72, a bottom edge portion 144 defining the lowermost portion of inner edge 72, and first and second side edge portions 146, 148 defining the side-to-side extremes of inner edge 72 as shown in FIG. 6. Illustratively, edge portions 142, 144, 146, 148 can cooperate to define recessed surface 74 generally in the shape of an oval as shown in FIG. 6.

It will also be clear to those skilled in the art that although illustrative and preferred transition surface 76 is a generally uniformly-sized surface as shown in FIGS. 5 and 6, inner edge 72 need not be evenly spaced apart from outer edge 60 along the entire inner edge 72. In addition, it will be clear that the shape defined by inner edge 72 need not be the same as the shape defined by outer edge 60. Thus, the size and shape of recessed portion 62 defined by outer edge 60 and of generally planar recessed surface 74 defined by inner edge 72 can be varied without exceeding the scope of the invention as presently perceived as long as side bar 33 is spaced apart from recessed surface 74 by the grasping distance so that a pallbearer can grasp side bar 33 without engaging side surface 66 of first side panel 28.

Side bar 33 includes hand grip 70 that is grasped by the pallbearer and that is defined as the portion of side bar 33 positioned to lie between plane e and plane f as shown in FIGS. 5 and 6. Thus, recessed portion 62 provides a "target" to direct the pallbearer to a specified position along side bar 33 so that the pallbearers are evenly spaced apart and properly distributed along first side panel 28 and second side panel 29 of casket shell 12 when carrying casket 10.

Although neither head end panel 27 nor foot end panel 27 of illustrative and preferred casket shell 12 are formed to include a recessed portion 62, it is within the scope of the invention as presently perceived to provide a head end panel or a foot end panel having one or more recessed portions, without exceeding the scope of the invention as presently perceived. For example, a head end panel can be provided having two corner bosses 38 and one side boss 36 mounted to the head end panel and an end bar 32 extending therebetween as shown for illustrative head end panel 26 in FIG. 1. If desired, the head end panel could be formed to include recessed portions positioned to lie between each boss 34 in a manner similar to that shown for illustrative first side panel 28 in FIG. 1.

It is also within the scope of the invention as presently perceived to provide a head end panel having two corner bosses mounted thereto, an end bar extending therebetween, and only one recessed portion formed in the head end panel behind the end bar. It is therefore within the scope of the invention as presently perceived to provide a casket shell having head and foot end panels having no recessed portions, one recessed portion, two recessed portions, or any reasonable number of recessed portions so that pallbearers can carry the casket shell by grasping bars adjacent to the end panels of the casket shell.

Figure 7:
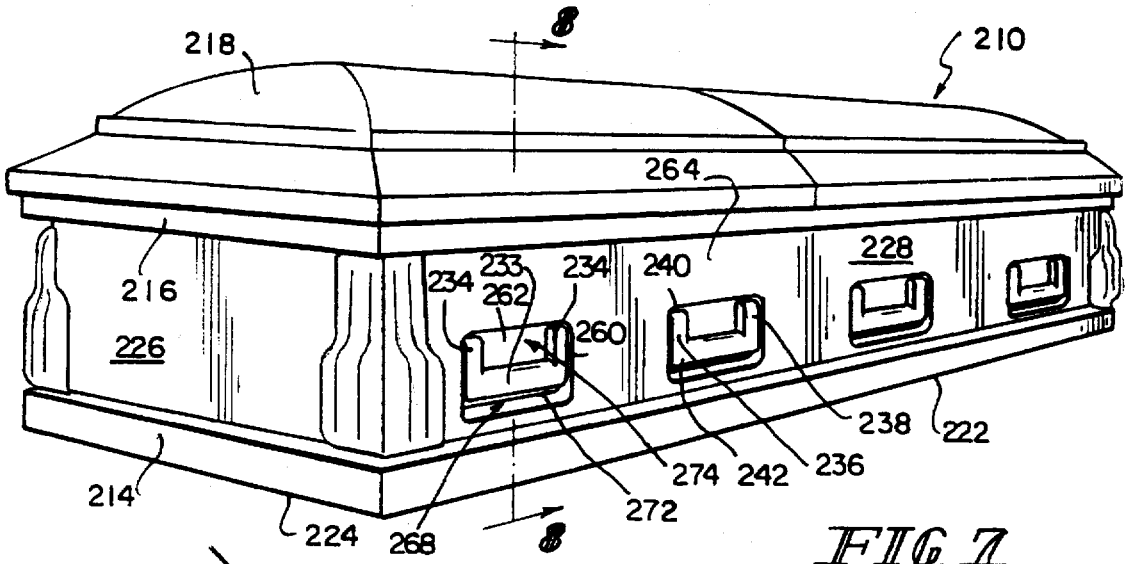
FIG. 7 is a perspective view of a second embodiment of a casket in accordance with the present invention showing a side panel of the casket shell having a side surface formed to include an outer portion, a plurality of recessed portions extending inwardly therefrom, and a plurality of side bars appended to swing hardware that is pivotably mounted the casket shell side panel, each bar being received in of one of the recessed portions and each bar having an outwardly-facing surface that is flush with the outer portion of the side panel when the bar is in the downward non-operative position.
Figure 8:
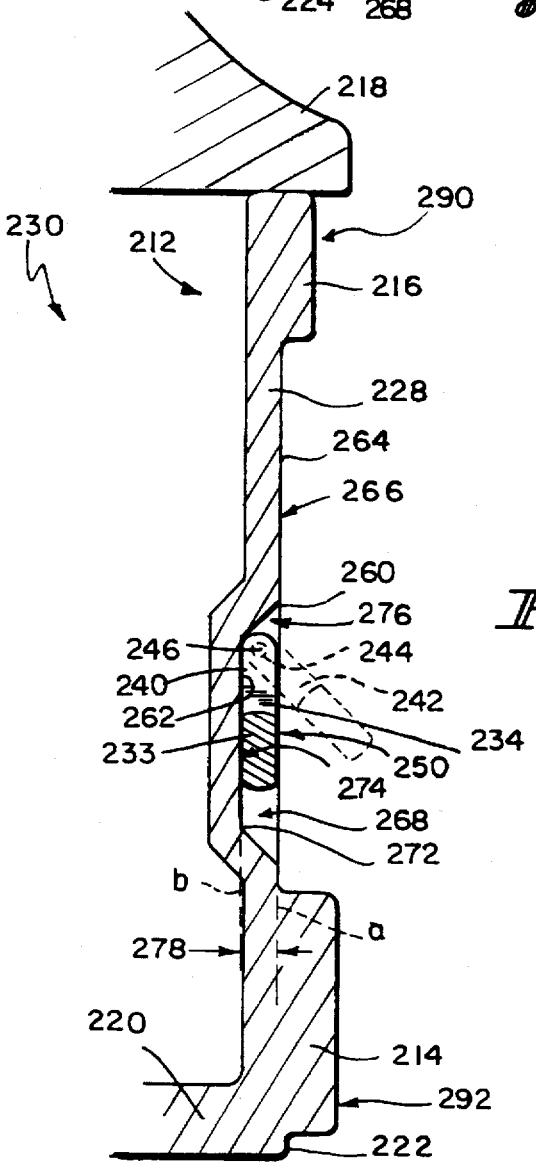
FIG. 8 is a sectional view taken along line 8—8 of FIG. 7 showing the shape of the side surface of the side panel adjacent to one of the recessed portions and the position of the side bar flush with the outer portion of the side panel when the side bar is in the downward non-operative position and spaced apart from the innermost portion of the recessed portion of the side panel when the side bar (in phantom) swings outwardly to the operative position.

A second illustrative embodiment of a casket 210 having a casket shell 212 is shown in FIG. 7. As with casket shell 12, casket shell 212 is formed to include a base 214 and an upper rim 216 as shown in FIGS. 7 and 8. A lid 218 is attached to rim 216 by conventional hinging mechanisms (not shown) and is movable between a closed position, shown in FIG. 7, and an open position having lid 218 away from rim 216 to display the contents of casket shell 212.

Casket shell 212 includes an elongated bottom 220 having an elongated first side edge 222, an elongated second side edge (not shown) spaced apart from first side edge 222, a head end edge 224, and a foot end edge (not shown) that is longitudinally spaced apart from head end edge 224. A head end panel 226 is attached to head end edge 224 and extends upwardly therefrom, a foot end panel (not shown) is attached to the foot end edge and extends upwardly therefrom, a first side panel 228 is attached to the first side edge and extends upwardly therefrom, and a second side panel (not shown) is attached to the second side edge and extends upwardly therefrom.

First side panel 228 and the second side panel cooperate with bottom 220, head end panel 226, and the foot end panel to define an interior region 230 of casket shell 212. Preferably, first side panel 228 and the second side panel are of unitary construction and can be formed by stamping first side panel 228 and the second side panel from a sheet of material, by molding the first side panel 228 and the second side panel, or by any other suitable forming process without exceeding the scope of the invention as presently perceived.

As with the first embodiment of casket shell 12, the foot end panel of casket shell 212 is substantially similar to head end panel 226 and the second side panel of casket shell 212 is substantially similar to first side panel 228. The description herein related to head end panel 226 is thus descriptive of the foot end panel and the description herein related to first side panel 228 is descriptive of the second side panel. Therefore, unless otherwise noted, the description below of head end panel 226 will also apply to the foot end panel and the description below of first side panel 228 will also apply to the second side panel.

First side panel 228 is formed to include an outwardly-facing side surface 266 having a plurality of longitudinally spaced-apart edges 260. Each edge 260 defines a recessed portion 262 of side surface 266 that is recessed inwardly from an outer portion 264 of side surface 266. Each recessed portion 262 defines a hand-grip cavity 268 as shown in FIGS. 7 and 8.

Each recessed portion 262 of casket shell 212 is preferably substantially similar to each other recessed portion 262 formed in side surface 266. The description below of one of recessed portions 262 with reference to FIG. 8 is descriptive of each recessed portion 262, and the description below of preferred recessed portion 262 should be taken as a description of each recessed portion 262 of side surface 266 of casket shell 212.

Edge 260 of side surface 266 of casket shell 212 is an outer edge of recessed portion 262 as shown in FIGS. 7 and 8. Recessed portion 262 also preferably includes an inner edge 272 defining a generally planar surface 274 that preferably also defines an innermost portion of recessed portion 262. A transition surface 276 is positioned to lie between outer edge 260 and inner edge 272. Although illustrative transition surface 276 is shown to incline gradually inwardly from outer edge 260 to inner edge 272 defining a ramped portion therebetween, it is within the scope of the invention as presently perceived for transition surface 276 to be at any reasonable angle relative to recessed surface 274, such as being generally perpendicular to recessed surface 274 or being at an acute angle with respect to recessed surface 274 so that inner edge 272 is larger than outer edge 260.

Outer portion 264 of side surface 266 of first side panel 228 defines a generally vertical outer plane indicated by line a (plane a extends perpendicular to the page in the illustrations) as shown in FIG. 8. Recessed surface 274 also defines a plane b (plane b extends perpendicular to the page in the illustrations). Plane b is inwardly spaced apart from plane a toward interior region 230 of casket shell 212 by a distance 278 as shown in FIG. 8.

A side bar 233 is appended to swing hardware 234 as shown in FIGS. 7 and 8 and swing hardware 234 is pivotably coupled to first side panel 228 so that side bar 233 can swing between a downward non-operative position outwardly to an operative position when the casket is carried. Illustrative swing hardware 234 includes first and second arms 236, 238, each arm 236, 238 having a proximal end 240 pivotably coupled to first side panel 228 and a distal end 242 attached to side bar 233.

Preferably, each arm 236, 238 includes a pin 244 appended to proximal end 240 and extending generally horizontally away from side bar 233, pins 244 defining a pivot axis 246 of swing hardware 234 as shown in FIG. 8. Transition surface 276 is formed to include a pair of opposing openings (not shown), each of which rotatably receives one of pins 244 so that swing hardware 234 and side bar 233 can swing relative to first side panel 228.

Side bar 233 and swing hardware 234 are received in hand-grip cavity 268 as shown in FIGS. 7 and 8 when side bar 233 is in the non-operative position. Side bar 233 and swing hardware 234 are formed to include an outwardly-facing surface 250 that is preferably generally coplanar with plane a when side bar 233 and swing hardware 234 are in the downward non-operative position as shown in FIG. 8. Thus, an outer surface 290 of upper rim 216 and an outer surface 292 of base 214 define the outer extremities of casket shell 212 when side bar 233 is in the non-operative position. Side bar 233 and swing hardware 234 extend outwardly from plane a when in the operative position so that side bar 233 can be easily grasped by a pallbearer carrying casket 210.

An outer surface 292 of base 214 of casket shell 212 defines the outermost extremity of casket shell 212 as shown best in FIG. 8. Forming casket shell 212 without bosses 34 or other hardware extending outwardly beyond outer surface 292 provides an efficient utilization of space allowing for the size of casket shell 212 to be maximized while still keeping the outer extremities of casket 210 within the limited envelope of space surrounding casket shell 212.

Preferably, side bar 233 and first and second arms 236, 238 of swing hardware 234 are of unitary construction as shown in FIGS. 7 and 8. However, it is within the scope of the invention as presently perceived to provide a separate side bar made from a plastics material, metal, wood, or any other suitable material and separate first and second arms 236, 238 made from a plastics material, metal, wood, or any other suitable material that are coupled to first side panel 228 and positioned as described above.

Illustrative casket shell 12 is shown in FIGS. 1 and 2 to provide four recessed portions 62 and five bosses 34 on each of the first and second side panels 28, 29, and casket shell 312 is shown in FIG. 7 to provide four recessed portions 262 on first side panel 228. However, side panels 28, 29, 228 may be formed to include any number of spaced-apart recessed portions 62, 262 which may be interleaved between bosses 34 as desired without exceeding the scope of the invention as presently perceived.

Figure 9:
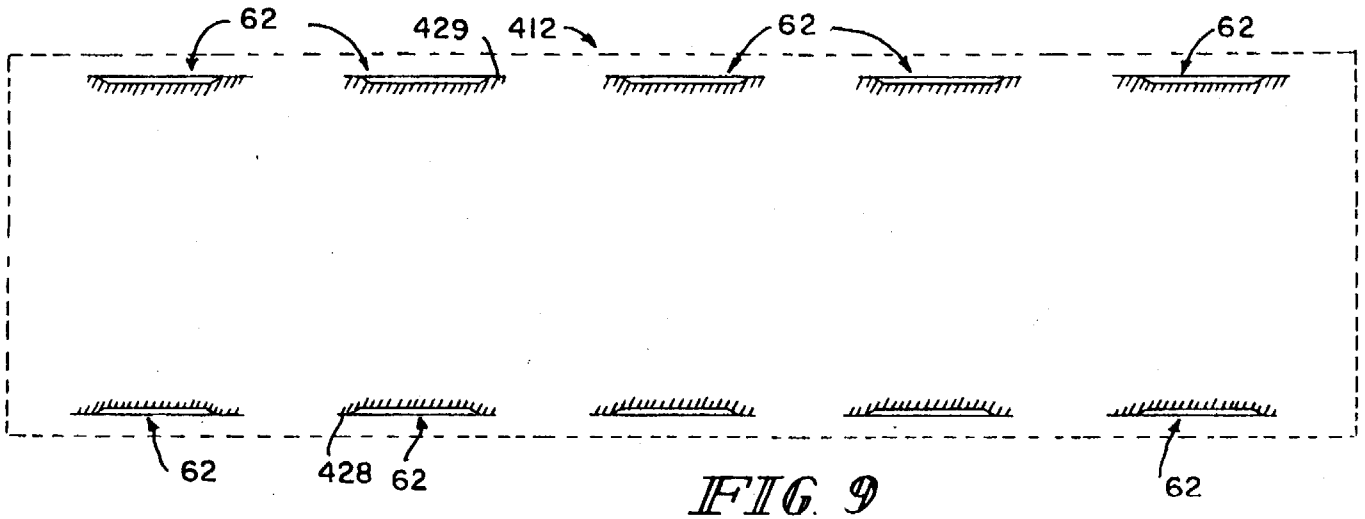
FIG. 9 is a diagrammatic view similar to FIG. 2 showing a casket shell for an over-sized casket having side panels that are each formed to include five recessed portions.
Figure 10:
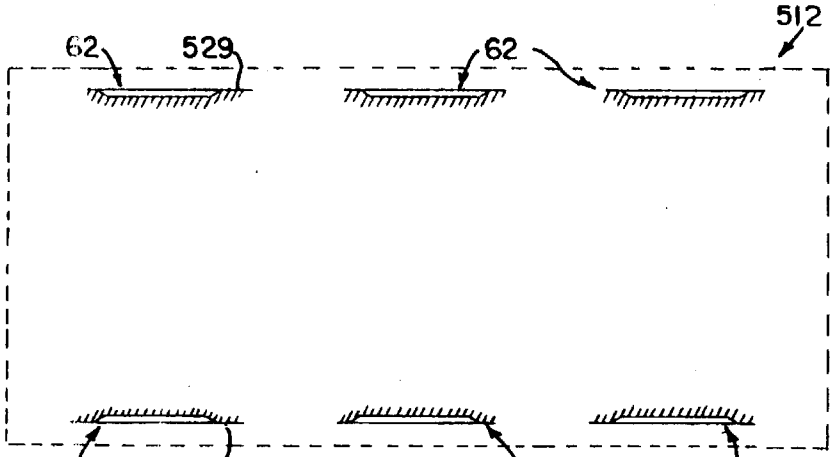
FIG. 10 is a diagrammatic view similar to FIG. 9 showing a casket shell for an under-sized casket having side panels that are each formed to include three recessed portions.
Figure 11:
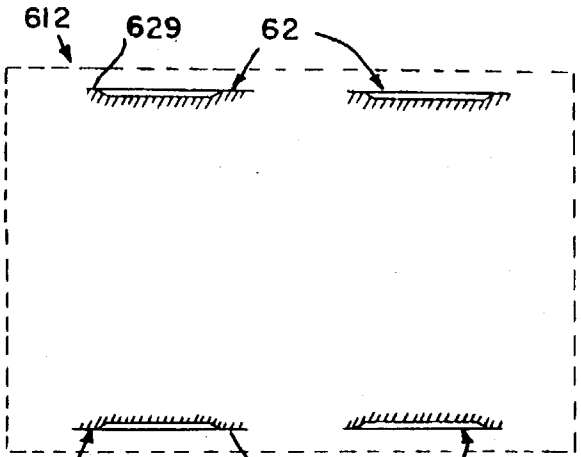
FIG. 11 is a diagrammatic view similar to FIG. 10 showing a casket/shell for an under-sized casket having side panels that are each formed to include two recessed portions.

For example, a casket shell 412 can be a shell for an "over-sized" casket and can include side panels 428, 429, each of which is formed to include five recessed portions 62, 262 (as indicated by reference numerals 62 in the illustration) as shown diagrammatically in FIG. 9. For another example, a casket shell 512 can be a shell for an "under-sized" casket for infants, children, or other under-sized people or animals and can include side panels 528, 529, each of which is formed to include three recessed portions 62, 262 (as indicated by reference numerals 62 in the illustration) as shown diagrammatically in FIG. 10, or a casket shell 612 can include side panels 628, 629, each of which is formed to include two recessed portions 62, 262 (as indicated by reference numerals 62 in the illustration) as shown diagrammatically in FIG. 11. It can be seen, then, that casket shell 12, 212 can be formed to include any desired and reasonable number of recessed portions 62, 262 for defining hand-grip cavities 68, 268 without exceeding the scope of the invention as presently perceived.

Casket shell 12 in accordance with the present invention having a handle including recessed portions 62 and side bar 33 provides a casket 10 that is conveniently sized for fitting within a limited envelope of space surrounding casket 10 during storage, during transport on shipping pallets (not shown) or in other shipping containers (not shown), and during use when casket 10 is placed into a mausoleum (not shown) or a burial vault (not shown). Side bar 33 of casket shell 12 is fixed relative to first side panel 28 and relative to recessed portions 62. Thus, casket 10 includes no moving hardware that can swing during shipment or during other handling operations of casket 10, thereby eliminating the possibility of damaging adjacent caskets, damaging casket 10, damaging such movable hardware, or damaging any adjacent objects.

However, if it is desired to mount side bar 233 on swing hardware 234 so that side bar 233 can swing relative to the casket shell 212, casket shell 212 can accommodate swing hardware 234 by positioning side bar 233 and swing hardware 234 within recessed portions 262. Preferably, side bars 233 and swing hardware 234 are mounted so that side bars 233 are received by recessed portions 262 and are flush with generally vertical plane a defined by outer portion 264 of side surface 266 when side bars 233 are in the downward non-operative position. Also, preferred side bars 233 swing outwardly to the operative position when casket 210 is carried. Mounting side bars 233 and swing hardware 234 within hand-grip cavity 268 provides for an efficient use of space allowing the size of casket shell 212 to be maximized while still fitting within the limited envelope of space surrounding casket 210.

Although the invention has been described in detail with reference to preferred embodiments, additional variations and modifications exist within the scope and spirit of the invention as described and defined in the following claims.

We claim:

1. A casket comprising a bar, and a casket shell spaced apart from the bar and including a side panel having an outwardly-facing side surface fixed relative to the bar, the side surface including an outer portion defining a generally vertical outer plane and a recessed portion positioned inwardly of the outer portion of the side surface and cooperating therewith to define a cavity positioned behind the bar so that a person carrying the casket can grip the bar without engaging the side surface, the outer plane extending between the recessed portion and the bar.

2. The casket of claim 1, wherein the side surface includes an outer edge defining the recessed portion and the side surface further includes an inner edge in the recessed portion defining a generally planar recessed surface spaced apart from and positioned inwardly of the outer plane.

3. The casket of claim 2, wherein the recessed portion includes a ramped portion between the outer edge and the inner edge.

4. The casket of claim 2, wherein the inner edge includes a top edge portion, a bottom edge portion spaced apart from the top edge portion, and two side edge portions therebetween arranged so that the recessed surface is generally rectangular.

5. The casket of claim 2, wherein the outer edge is generally oval to define a generally oval recessed portion and the inner edge is generally oval to define a generally oval recessed surface.

6. The casket of claim 2, wherein the bar includes an elongated top and an elongated bottom spaced apart from the top, the top of the bar is vertically spaced apart a first distance from an uppermost portion of the inner edge, the bottom of the bar is vertically spaced apart a second distance from a lowermost portion of the inner edge, and the first distance is greater than the second distance.

7. The casket of claim 1, wherein the side surface includes an edge that defines the recessed portion and the edge includes a longitudinally extending top edge portion, a bottom edge portion spaced apart from the top edge portion, and two side edge portions therebetween arranged so that the recessed portion is generally rectangular.

8. The casket of claim 1, wherein the bar includes an elongated top and an elongated bottom spaced apart from the top, the top of the bar is vertically spaced apart a first distance from an uppermost portion of the edge and the bottom of the bar is vertically spaced apart a second distance from a lowermost portion of the edge, and the first distance is greater than the second distance.

9. The casket of claim 1, further comprising a second bar, wherein the casket shell includes an end panel spaced apart from the second bar and having an outwardly-facing end surface positioned behind the bar and fixed relative thereto, the end surface including an outer portion and an edge defining a recessed portion of the end surface positioned inwardly of the outer portion of the side surface and cooperating therewith to define a cavity positioned behind the second bar so that a person carrying the casket can grip the second bar without engaging the end surface.

10. A casket shell comprising an elongated bottom having first and second spaced apart side edges, first and second elongated side panels attached to the side edges and extending upwardly therefrom defining a casket shell interior region, the first side panel having a side surface including an outer portion of the side surface defining a generally vertical outer plane and being formed to include a recessed portion of the side surface spaced apart from and positioned inwardly of the outer plane, and a bar fixed relative to the first side panel, the bar being positioned to lie in front of the recessed portion and the outer plane so that a person carrying the casket shell can grip the bar without engaging the recessed surface.

11. The casket shell of claim 10, wherein the recessed portion includes an inner edge defining a generally planar recessed surface.

12. The casket shell of claim 11, wherein the side surface includes an outer edge and the outer edge and the inner edge are spaced apart to form a transition surface therebetween.

13. The casket shell of claim 12, wherein the transition surface is generally perpendicular to the outer plane.

14. The casket shell of claim 12, wherein the transition surface angles inwardly from the outer portion of the side surface to the recessed surface forming a gradual ramp therebetween.

15. The casket shell of claim 11, wherein the inner edge includes an uppermost top edge portion and a lowermost bottom edge portion and the bar includes an elongated top vertically spaced apart from and beneath the top edge portion by a first distance and an elongated bottom spaced apart from the top of the bar and vertically spaced apart from the bottom edge portion by a second distance.

16. The casket shell of claim 15, wherein the first distance is generally the same as the second distance.

17. The casket shell of claim 15, wherein the first distance is greater than the second distance.

18. The casket shell of claim 10, wherein the first side panel is formed to include a base having an outer surface extending outwardly past the outer portion of the side surface and a rim having an outer surface extending outwardly past the outer portion of the side surface, the outer surfaces of the base and the rim cooperate to define a generally vertical outer second plane spaced apart from and positioned outside of the outer plane, and the bar is positioned to lie between the outer plane and the second plane.

19. The casket shell of claim 10, wherein the bottom further includes a head end edge and further comprising a head end panels attached to the head end edge and extending upwardly therefrom, the head end panel having an end surface including an outer portion of the end surface defining a generally vertical outer plane and being formed to include an outer edge defining a recessed portion of the end surface spaced apart from and positioned inwardly of the outer plane, and a second bar fixed relative to the head end panel, the second bar being positioned to lie in front of the recessed portion of the head end panel and spaced apart from the head end panel so that a person carrying the casket shell can grip the second bar without engaging the recessed surface of the head end panel.

20. A casket shell comprising an elongated bottom having first and second spaced apart side edges, first and second elongated side panels attached to the side edges and extending upwardly therefrom defining a casket shell interior region, the first side panel having a side surface including an outer portion of the side surface defining a generally vertical outer plane and being formed to include an outer edge defining a recessed portion of the side surface spaced apart from and positioned inwardly of the outer plane, and a bar fixed relative to the first side panel, the bar being positioned to lie in front of the recessed portion and spaced apart from the first side panel so that a person carrying the casket shell can grip the bar without engaging the recessed surface, the casket shell further comprising a first mounting boss projecting outwardly from the outer portion of the side surface and a second mounting boss projecting outwardly from the outer portion of the side surface and longitudinally spaced apart from the first mounting boss, the recessed portion being positioned to lie between the first and second mounting bosses, and the bar including a first end fixed to the first mounting boss and a second end fixed to the second mounting boss so that the bar extends along the full length of the recessed portion.

21. A casket shell comprising an elongated bottom having first and second spaced apart side edges, first and second elongated side panels attached to the side edges and extending upwardly therefrom defining a casket shell interior region, the first side panel having a side surface including an outer portion of the side surface defining a generally vertical outer plane and being formed to include an outer edge defining a recessed portion of the side surface spaced apart from and positioned inwardly of the outer plane, and a bar fixed relative to the first side panel, the bar being positioned to lie in front of the recessed portion and spaced apart from the first side panel so that a person carrying the casket shell can grip the bar without engaging the recessed surface, wherein the first side panel includes a plurality of outer edges each of which defines a recessed portion of the side surface spaced apart from and positioned inwardly of the outer plane so that the first side panel includes a plurality of longitudinally spaced apart recessed portions.

22. The casket shell of claim 21, wherein the comprising a first mounting boss projecting outwardly from the outer portion of the side surface and a second mounting boss projecting outwardly from the outer portion of the side surface and longitudinally spaced apart from the first mounting boss, the plurality of recessed portions being positioned to lie between the first and second mounting bosses, and the bar including a first end fixed to the first mounting boss and a second end fixed to the second mounting boss so that the bar extends along the full length of the plurality of recessed portions.

23. The casket shell of claim 21, further comprising a plurality of mounting bosses projecting outwardly from the outer portion of the side surface and arranged in an alternating arrangement with the plurality of recessed portions so that each recessed portion is positioned to lie between two mounting bosses, and a plurality of bars, each bar being fixed to an adjacent pair of mounting bosses so that each bar of the plurality of bars is positioned to lie in front of one recessed portion and is outwardly spaced apart therefrom.

24. The casket shell of claim 21, wherein the second side panel includes a side surface including an outer portion defining a generally vertical outer plane and a plurality of longitudinally spaced-apart edges each of which defines a recessed portion of the second side panel, each recessed portion being spaced apart from and positioned inwardly of the outer plane of the second side panel so that the second side panel includes a plurality of longitudinally spaced apart recessed portions.

25. A casket shell comprising an elongated bottom having first and second spaced apart side edges, first and second elongated side panels attached to the side edges and extending upwardly therefrom, the first side panel including a generally planar side surface defining a generally vertical outer plane, and a bar fixed relative to the side surface so that a person carrying the casket can grip the bar, the bar cooperating with the side surface of the first side panel to define a hand-receiving space receiving the hand of the person carrying the casket and the side surface being configured and the bar being positioned so that the outer plane passes through the hand-receiving space.

26. The casket shell of claim 25, wherein the side surface includes an outer portion and an edge defining a recessed portion positioned inwardly of the outer portion, the recessed portion defining a cavity positioned adjacent to the bar and the hand-receiving space including the cavity defined by the recessed portion.

27. The casket shell of claim 26, wherein the bar is spaced apart from the side surface and the hand-receiving space includes the space between the bar and the side surface.

28. The casket shell of claim 26, wherein the edge includes a top edge portion, a bottom edge portion spaced apart from the top edge portion, and first and second side edge portions therebetween, and the bar is an elongated bar having a first end extending past a first transverse plane defined by the first side edge and a second end extending past a second transverse plane defined by the second side edge.

29. The casket shell of claim 26, wherein the edge is an outer edge and the recessed portion further includes an inner edge defining a generally planar recessed surface.

30. A casket shell comprising an elongated bottom having elongated first and second spaced-apart side edges, a head end edge, and a foot end edge longitudinally spaced apart from the head end edge, a pair of end panels including a head end panel attached to the head end edge and extending upwardly therefrom and a foot end panel attached to the foot end edge and extending upwardly therefrom, first and second side panels attached to the first and second side edges, respectively, and extending upwardly therefrom, the first and second side panels cooperating with the bottom and the end panels to define an interior region of the shell, the first side panel being formed to include an outer portion of the side surface defining a generally vertical outer plane and a first edge defining a generally rectangular first recessed portion of the side surface recessed inwardly from the outer plane to define a hand grip cavity, the first recessed portion including an inner edge having a top edge portion and a bottom edge portion cooperating with two spaced-apart side edge portions of the inner edge to define a generally rectangular and generally planar recessed surface defining a recessed plane spaced apart from and inward of the outer plane, the first and second side panels being of unitary construction, and a generally horizontal bar positioned outside of the outer plane and spaced apart therefrom, the bar being fixed relative to the side surface in front of the recessed portion and having an elongated bottom vertically positioned above and spaced apart from the bottom edge portion and an elongated top spaced apart from the bottom of the bar and vertically spaced apart from the top edge portion by a first distance and vertically spaced apart from the bottom edge portion by a second distance that is generally equal to the first distance so that a person carrying the casket shell can grip the bar without engaging the first side panel.

31. The casket shell of claim 30, wherein the first side panel further includes a second edge spaced apart from the first edge and defining a second generally rectangular recessed portion longitudinally spaced-apart from the first recessed portion and defining a hand grip cavity, the first and second recessed portions being generally vertically aligned along the outer surface.

32. The casket shell of claim 31, wherein the bar extends longitudinally and is positioned in front of both of the first and second recessed portions.

33. The casket shell of claim 31, further comprising a generally horizontal second bar positioned outside of the outer surface and spaced apart therefrom, the second bar being longitudinally spaced apart from the first bar and fixed relative to the outer surface in front of the recessed portion.

34. A casket shell comprising an elongated bottom having first and second spaced apart side edges, first and second elongated side panels attached to the side edges and extending upwardly therefrom, the first side panel including an outward first surface and an inward second surface displaced from the first surface, and a bar spaced apart from the first side panel and fixed relative thereto, the outward first surface and the inward second surface being positioned behind the bar.

35. The casket shell of claim 34, wherein the outward first surface defines a generally vertical outer plane, the inward second surface defines a second plane generally parallel to the outer plane, and the bar is outwardly spaced apart from the outer plane.

36. The casket shell of claim 34, wherein the first side panel is of unitary construction so that the first surface is connected to the second surface by a transition surface.

37. A casket comprising a bar, a casket shell coupled to and spaced apart from the bar and including a side panel having an outwardly-facing side surface, the side surface including an outer portion and a recessed portion of the side surface positioned inwardly of the outer portion of the side surface and cooperating therewith to define a cavity positioned behind the bar, a first mounting boss projecting outwardly from the outer portion of the side surface, and a second mounting boss projecting outwardly from the outer portion of the side surface and longitudinally spaced apart from the first mounting boss, the recessed portion being positioned to lie between the first and second mounting bosses, and the bar including a first end fixed to the first mounting boss and a second end fixed to the second mounting boss so that the bar extends along the full length of the recessed portion.

38. A casket comprising a bar and a casket shell coupled to and spaced apart from the bar and including a side panel having an outwardly-facing side surface, the side surface including an outer portion defining a generally vertical outer plane and a recessed portion of the side surface positioned inwardly of the outer portion of the side surface and cooperating therewith to define a cavity positioned behind the bar, wherein the side panel includes a plurality of recessed portions spaced apart from and positioned inwardly of the outer plane so that the side panel includes a plurality of longitudinally spaced apart recessed portions.

* * * * *